US008882974B2

(12) United States Patent
Huang et al.

(10) Patent No.: US 8,882,974 B2
(45) Date of Patent: Nov. 11, 2014

(54) SUPPORT MECHANISM

(71) Applicant: Hong Fu Jin Precision Industry (ShenZhen) Co., Ltd., Shenzhen (CN)

(72) Inventors: Tian-Feng Huang, Shenzhen (CN); Bo Li, Shenzhen (CN); Wen-Li Wang, Shenzhen (CN); Hao-Chung Lee, New Taipei (TW)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 6 days.

(21) Appl. No.: 13/779,750

(22) Filed: Feb. 28, 2013

(65) Prior Publication Data

US 2013/0228455 A1 Sep. 5, 2013

(30) Foreign Application Priority Data

Mar. 5, 2012 (CN) ..... 2012 1 0054490

(51) Int. Cl.
*C25F 7/00* (2006.01)
*C25F 3/16* (2006.01)

(52) U.S. Cl.
CPC .... *C25F 7/00* (2013.01); *C25F 3/16* (2013.01)
USPC ..... 204/297.06; 204/198; 204/288.1; 204/297.01

(58) Field of Classification Search
CPC ..... C25F 7/00; C25D 17/007–17/008; C25D 17/06–17/08
USPC ..... 204/198, 285, 286.1, 287, 288.1, 288.6, 204/297.01, 297.06
See application file for complete search history.

(56) References Cited

U.S. PATENT DOCUMENTS 4,189,360 A * 2/1980 Woods et al. ..... 205/145
8,398,830 B2 * 3/2013 Son ..... 204/286.1

* cited by examiner

*Primary Examiner* — Nicholas A Smith
*Assistant Examiner* — Brian W Cohen
(74) *Attorney, Agent, or Firm* — Novak Druce Connolly Bove + Quigg LLP

(57) ABSTRACT

A support mechanism used in an electro plasma polishing process includes a support beam, a first electrically conducting assembly, and a second electrically conducting assembly. The first electrically conducting assembly and the second electrically conducting assembly are mounted on the support beam. The first electrically conducting assembly is electrically insulated from the second electrically conducting assembly.

11 Claims, 7 Drawing Sheets

SUPPORT MECHANISM

BACKGROUND

1. Technical Field

The present disclosure relates to support mechanisms, and particularly to a support mechanism used in an electro plasma polishing process.

2. Description of Related Art

In an electro plasma polishing process, a plurality of workpieces is fixed on a fixture, the fixture with the workpieces is then mounted on a support mechanism. The support mechanism is electrically connected to an anode, and then is mounted on a lifting device. The workpiece mounted on the fixture is immersed in an electrolyte solution and electrically connected to a cathode and polished. However, since the support mechanism is electrically connected to a single anode, the power supplied to the workpiece mounted on the fixture is limited, thereby limiting the polishing efficiency.

Therefore, there is room for improvement in the art.

BRIEF DESCRIPTION OF THE DRAWINGS

The components in the drawings are not necessarily drawn to scale, the emphasis instead placed upon clearly illustrating the principles of the present disclosure. Moreover, in the drawings, like reference numerals designate corresponding parts throughout the several views.

DETAILED DESCRIPTION

Figure 1:
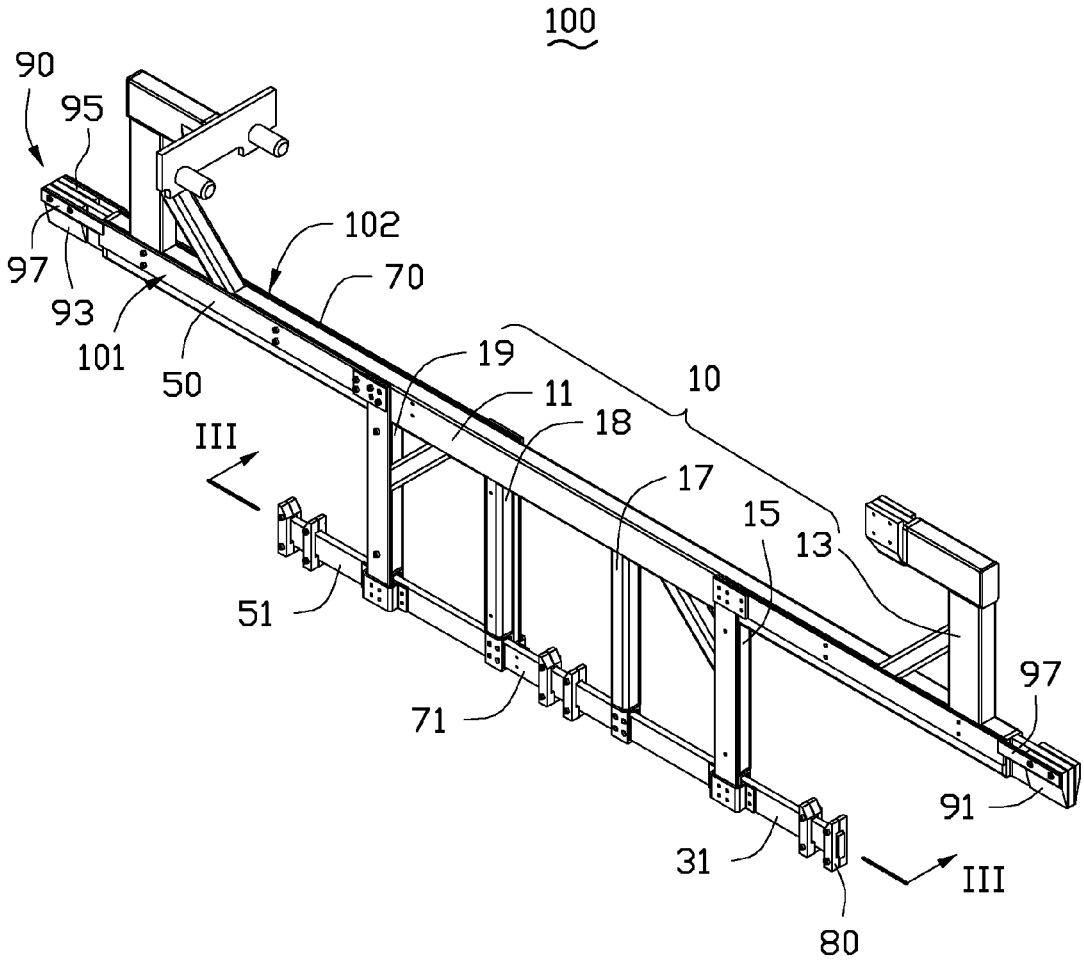
FIG. 1 is an isometric, assembled view of a first embodiment of a support mechanism.

FIGS. 1 through 6 show a support mechanism 100 of a first embodiment for supporting a plurality of fixtures 200 during an electro plasma polishing process. The support mechanism 100 includes a support beam 10, a first electrically conducting assembly 30, a second electrically conducting assembly 50, a third electrically conducting assembly 70, a plurality of positioning assemblies 80, and a connection assembly 90. The first electrically conducting assembly 30, the second electrically conducting assembly 50, and the third electrically conducting assembly 70 are mounted on the support beam 10, and are electrically connected to three different external anodes (not shown) by the connection assembly 90.

Figure 2:
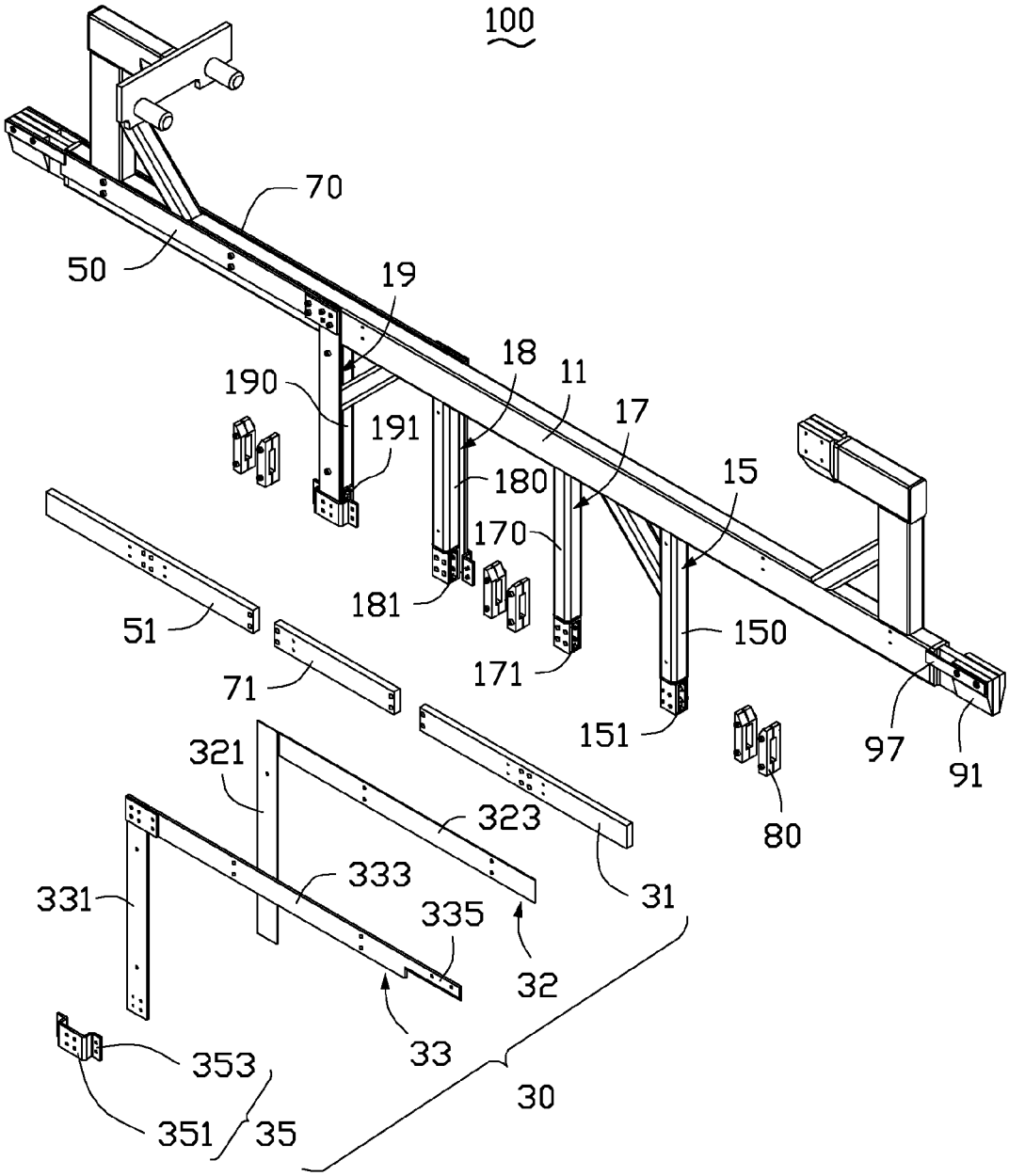
FIG. 2 is an isometric, exploded view of the support mechanism of FIG. 1.
Figure 6:
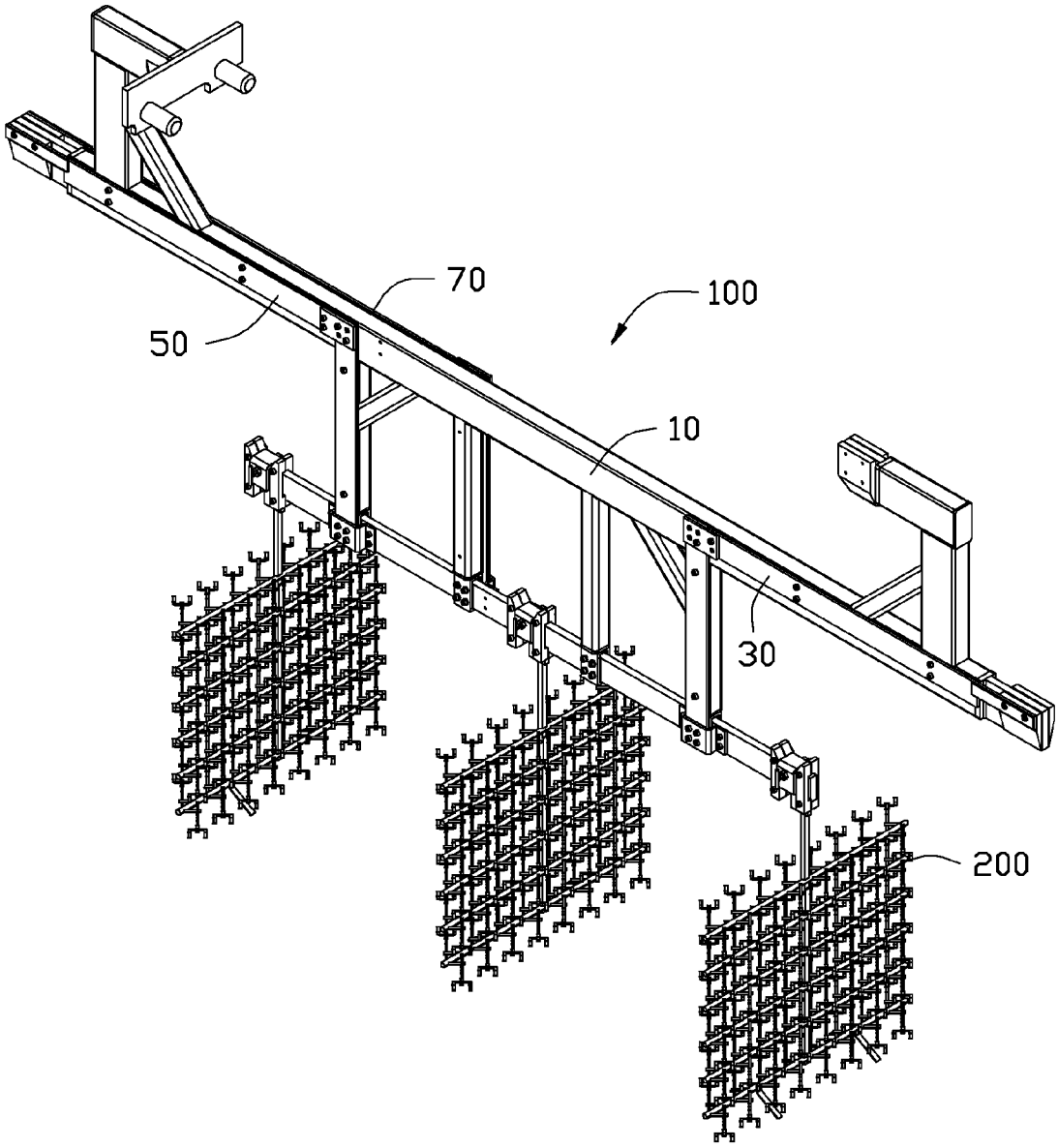
FIG. 6 is similar to FIG. 5, but viewed from another aspect.

Referring also to FIGS. 2 and 6, the first electrically conducting assembly 30 and the second electrically conducting assembly 50 are separately mounted on one side of the support beam 10. The third electrically conducting assembly 70 is mounted on an opposite side of the support beam 10 corresponding to the second electrically conducting assembly 50.

The support beam 10 includes a main body 11, two connecting portions 13, a first mounting portion 15, a second mounting portion 17, a third mounting portion 18, and a fourth mounting portion 19. The main body 11 is strip-like, and includes a first side surface 101 and a second side surface 102 opposite to the first side surface 101. Each connecting portion 13 extends perpendicularly from the main body 11 adjacent to one end thereof. The two connecting portions 13 are connected to an external lifting device.

The first mounting portion 15, the second mounting portion 17, the third mounting portion 18, and the fourth mounting portion 19 extend perpendicularly from the main body 11, and are parallel to each other. The first mounting portion 15 includes a body portion 150 and a first sleeve 151. One end of the body portion 150 is connected to the main body 11, and the other end of the body portion 150 is connected to the first sleeve 151. An inner surface of the first sleeve 151 is electrically insulated. The second mounting portion 17 includes a body portion 170, a second sleeve 171, and a first electrically insulating sheet 173 (referring to FIGS. 3 and 4). One end of the body portion 170 is connected to the main body 11, and the other end (free end) of the body portion 170 is connected to the second sleeve 171. An inner surface of the second sleeve 171 is electrically insulated. The first electrically insulating sheet 173 is placed in a substantially middle portion of the second sleeve 171. The third mounting portion 18 includes a body portion 180, a third sleeve 181, and a second electrically insulating sheet 183 (referring to FIGS. 3 and 4). One end of the body portion 180 is connected to the main body 11, and the other end of the body portion 180 is connected to the third sleeve 181. An inner surface of the third sleeve 181 is electrically insulated. The second electrically insulating sheet 183 is placed in a substantially middle portion of the third sleeve 181. The fourth mounting portion 19 includes a body portion 190 and a fourth sleeve 191. One end of the body portion 190 is connected to the main body 11, and the other end of the body portion 190 is connected to the fourth sleeve 191. An inner surface of the fourth sleeve 191 is electrically insulated.

Figure 3:
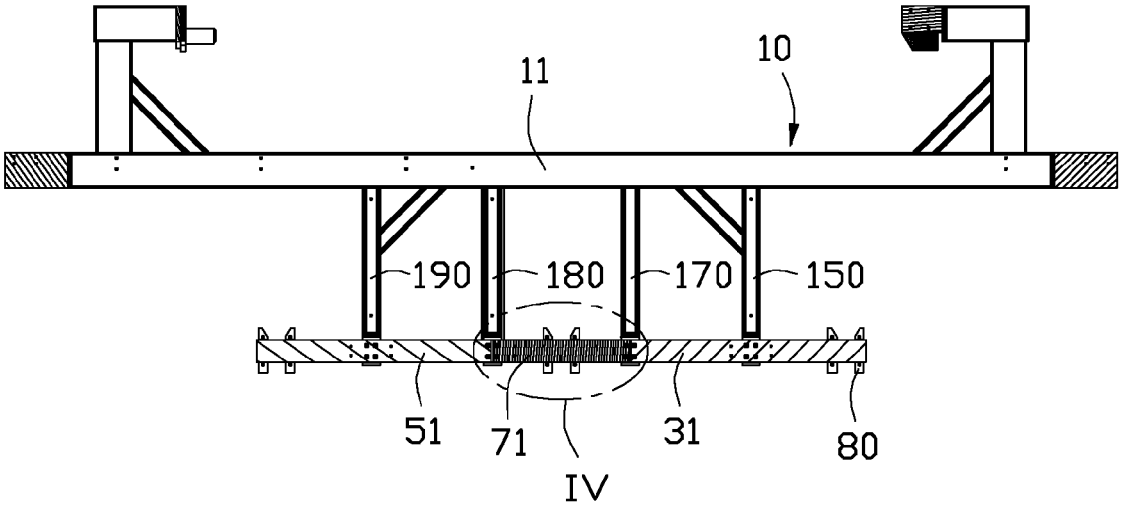
FIG. 3 is a cross sectional view of the support mechanism of FIG. 1, taken along line III-III.
Figure 4:
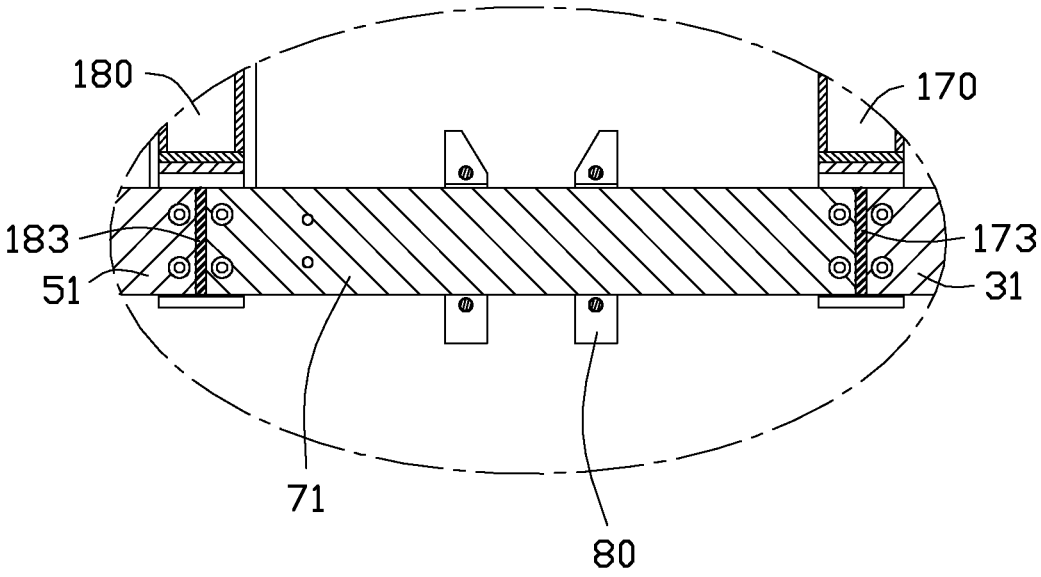
FIG. 4 is an enlarged view of a circled portion IV of FIG. 3.
Figure 5:
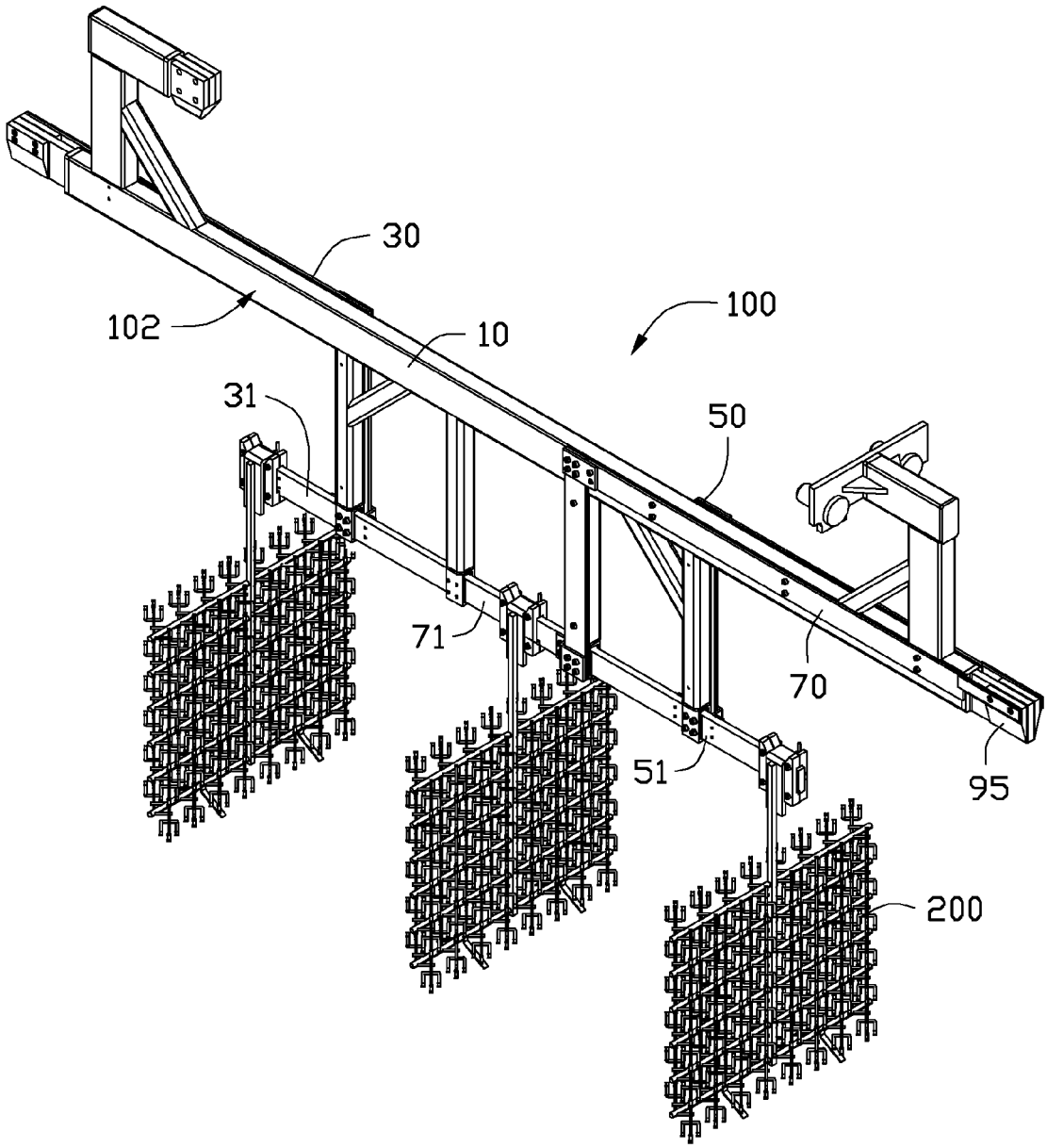
FIG. 5 shows a plurality of fixtures mounted on the support mechanism of FIG. 1.

Referring to FIGS. 2 and 3, the first electrically conducting assembly 30 is mounted on the first side surface 101 adjacent to one end of the main body 11, and includes a first bearing pole 31, an electrically insulating member 32, a first electrically conducting member 33, and a second electrically conducting member 35. One end of the first bearing pole 31 is extended through the first sleeve 151 and is then mounted in the second sleeve 171. A substantially middle portion of the first bearing pole 31 is mounted in the first sleeve 151. The electrically insulating member 32 is substantially L-shaped, and includes a first portion 321 and a second portion 323 substantially perpendicular to the first portion 321. The first portion 321 is mounted on a surface of the first mounting portion 15. The second portion 323 is mounted on a side surface of the main body 11 adjacent to one end thereof. The first electrically conducting member 33 is securely mounted on the electrically insulating member 32. The first electrically conducting member 33 has a shape and size similar to the electrically insulating member 32, and includes a first portion 331, a second portion 333 substantially perpendicular to the first portion 331, and a connecting portion 335 extending from a free end of the second portion 333 away from the first portion 331. The first portion 331 and the second portion 333 are mounted on the first portion 321 and the second portion 323, respectively. The connecting portion 335 is electrically connected to the connection assembly 90. The second electrically conducting member 35 includes a base portion 351 and two connecting portions 353 extending from opposite ends of the base portion 351 respectively. The base portion 351 is substantially U-shaped, and is sleeved on an end of the first portion 331 away from the second portion 333, such that the base portion 351 is electrically connected to the first electrically conducting member 33. Each connecting portion 353 is electrically connected to the first bearing pole 31, such that the first bearing pole 31 is electrically connected to the first electrically conducting member 33 by the second electrically conducting member 35.

The second electrically conducting assembly 50 has a structure similar to the first electrically conducing assembly 30, and is mounted on the first side surface 101 adjacent to the other end of the main body 11 opposite to the first electrically conducting assembly 30. One end of a second bearing pole 51 of the second electrically conducting assembly 50 is extended through the fourth sleeve 191, and then is mounted in the third sleeve 181. A substantially middle portion of the second bearing pole 51 is mounted in the fourth sleeve 191.

The third electrically conducting assembly 70 has a structure similar to the first electrically conducing assembly 30, and is mounted on the second side surface 102 between the first electrically conducting assembly 30 and the second electrically conducting assembly 50. One end of a third bearing pole 71 of the third electrically conducting assembly 70 is mounted in the second sleeve 171, and electrically insulated from the first bearing pole 31 by having the first electrically insulating sheet 173, and the other end of the third bearing pole 71 is mounted in the third sleeve 181, and electrically insulated from the second bearing pole 51 by having the second electrically insulating sheet 183. In other words, one end of the third bearing pole 71 is connected to but electrically insulated from the first bearing pole 31 via the second mounting portion 17, and the other end of the third bearing pole 71 is connected to but electrically insulated from the second bearing pole 51 via the third mounting portion 18.

In the illustrated embodiment, the first bearing pole 31 is substantially the same size as the second bearing pole 51, but larger than the third bearing pole 71. The first bearing pole 31, the second bearing pole 51, and the third bearing pole 71 are made of electrically conductive materials.

The positioning assemblies 80 are sleeved on the first bearing pole 31, the second bearing pole 51, and the third bearing pole 71, for positioning the fixtures 200. In the illustrated embodiments, the support mechanism 100 includes three positioning assemblies 80 sleeved on the first, second, and third bearing poles 31, 51, 71, respectively.

The connection assembly 90 includes a first connection seat 91, a second connection seat 93, a third connection seat 95, and three fixing members 97. The first connection seat 91 is mounted on the first side surface 101 at the end of the main body 11 adjacent to the first electrically conducting assembly 30, and is electrically connected to the first electrically conducting assembly 30 by means of or using one of the three fixing members 97. The second connecting seat 93 is mounted on the first side surface 101 at the other end of the main body 11 adjacent to the second electrically conducting assembly 50, and is electrically connected to the second electrically conducting assembly 50 by means of or using another one of the three fixing members 97. The third connecting seat 95 is mounted on the second side surface 102 at the other end of the main body 11 adjacent to the third electrically conducting assembly 70, and is electrically connected to the third electrically conducting assembly 70 by means of or using another one of the three fixing members 97. The first connection seat 91, the second connection seat 93, and the third connection seat 95 are electrically connected to three different outer anodes, respectively. Therefore, the first bearing pole 31, the second bearing pole 51, and the third bearing pole 71 are electrically connected to the three different external anodes, respectively, and are electrically insulated from each other.

During usage, three fixtures 200 are mounted on the first, second, and third bearing poles 31, 51, 71, respectively, and positioned by the positioning assemblies 80. The connecting portions 13 are connected to the external lifting device, and the first connection seat 91, the second connection seat 93, and the third connection seat 95 are electrically connected to three different external anodes, respectively. After supplying current to the external anodes, the support mechanism 100 is moved by the external lifting device, and the fixtures 200 are immersed in an electrolyte solution and the workpieces are electro plasma polished.

In other embodiments, if more power is supplied, more fixtures 200 can be mounted on the first bearing pole 31, the second bearing pole 51, and the third bearing pole 71.

Because the first connection seat 91, the second connection seat 93, and the third connection seat 95 are electrically connected to three different external anodes, respectively, a total power capacity is thereby greater. Thus, polishing efficiency is improved.

In other embodiments, the support mechanism 100 can further include other electrically conducting assemblies, or an electrically conducting assembly can be omitted, as needed.

Figure 7:
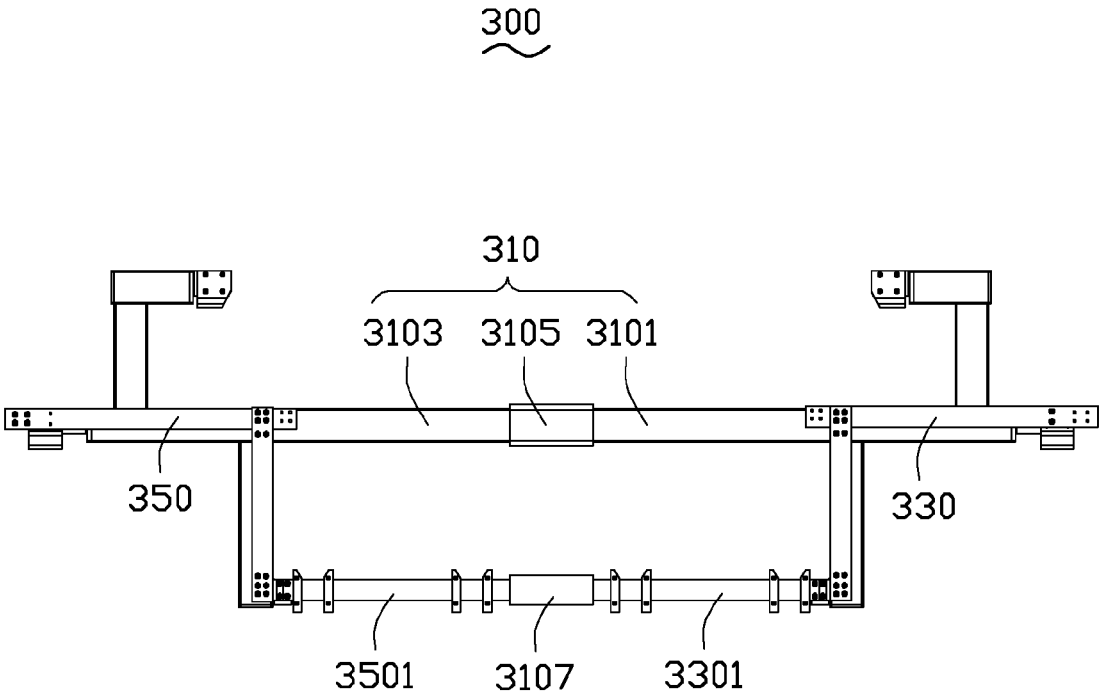
FIG. 7 is a side view of a second embodiment of a support mechanism.

FIG. 7 shows a support mechanism 300 of a second embodiment for supporting a plurality of fixtures 200 during an electro plasma polishing process. The support mechanism 300 has a structure similar to the support mechanism 100. However, a support beam 310 of the support mechanism 300 includes a first support portion 3101, a second support portion 3103, and an electrically insulating connecting member 3105 connecting the first support portion 3101 to the second support portion 3103. The support mechanism 300 includes a first electrically conducting assembly 330 and a second electrically conducting assembly 350. The first electrically conducting assembly 330 is mounted on the first support portion 3101, and the second electrically conducting assembly 350 is mounted on the second support portion 3103. A first bearing pole 3301 of the first electrically conducting assembly 330 and a second bearing pole 3501 of the second electrically conducting assembly 350 are connected by an electrically insulating member 3107. Therefore, the first electrically conducting assembly 330 and the second electrically conducting assembly 350 are electrically insulated from each other.

While various embodiments have been described and illustrated, the disclosure is not to be construed as being restricted thereto. Various modifications can be made to the embodiments by those skilled in the art without departing from the true spirit and scope of the disclosure as defined by the appended claims.

What is claimed is:

1. A system for use in an electro plasma polishing apparatus, the system comprising;

an electrolyte solution;

at least one power supply; and a support mechanism comprising:

a support beam;

a first electrically conducting assembly mounted on the support beam;

a second electrically conducting assembly mounted on the support beam;

a third electrically conducting assembly electrically mounted on the support beam, wherein the first electrically conducting assembly, the second electrically conducting assembly and the third electrically conducting assembly are insulated from each other and each electrically conducting assembly may be connected to a power supply; and the first electrically conducting assembly and the second electrically conducting assembly are separately mounted only on one side of the support beam, and the third electrically conducting assembly is mounted only on an opposite side of the support beam corresponding to the second electrically conducting assembly.

2. The system of claim 1, wherein the support beam comprises a main body, a first mounting portion, a second mounting portion, a third mounting portion, and a fourth mounting portion; the first mounting portion, the second mounting portion, the third mounting portion, and the fourth mounting portion are extending from the main body, respectively; the first electrically conducting assembly comprises a first bearing pole, the second electrically conducting assembly comprises a second bearing pole, the third electrically conducting assembly comprises a third bearing pole, one end of the third bearing pole is connected to but electrically insulated from the first bearing pole by the second mounting portion, and the other end of the third bearing pole is connected to but electrically insulated from the second bearing pole by the third mounting portion.

3. The system of claim 2, wherein the second mounting portion comprises a body portion, a sleeve, and an electrically insulating sheet, the body portion extends from the main body of the support beam, the sleeve is connected with a free end of the body portion, an inner surface of the sleeve is electrically insulated, the electrically insulating sheet is placed in the sleeve, and one end of the first bearing pole and one end of the third bearing pole are mounted in the sleeve and are electrically insulated from each other by the electrically insulating sheet.

4. The system of claim 3, wherein the first electrically conducting assembly further comprises a second electrically conducting member, the first electrically conducting member is electrically connected to the first bearing pole by the second electrically conducting member.

5. The system of claim 4, wherein the second electrically conducting member comprises a base portion and two connecting portions extending from opposite ends of the base portion respectively, the base portion is substantially U-shaped and sleeved on the first electrically conducting member.

6. The system of claim 2, wherein the first electrically conducting assembly further comprises an electrically insulating member and a first electrically conducting member, the electrically insulating member is mounted on the support beam, and the first electrically conducting member is mounted on the electrically insulating member.

7. The system of claim 6, wherein the electrically insulating member is substantially L-shaped and comprises a first portion and a second portion substantially perpendicular to the first portion.

8. The system of claim 2, wherein the support mechanism further comprises a plurality of positioning assemblies sleeved on the first bearing pole, the second bearing pole, and the third bearing pole.

9. The system of claim 1, wherein the support mechanism further comprises a connection assembly, the connection assembly comprises a first connection seat, a second connection seat, a third connection seat, and three fixing members, the first connection seat, the second connection seat, and the third connection seat are mounted on the support beam, the first connection seat is electrically connected to the first electrically conducting assembly by one of the three fixing members, the second connection seat is electrically connected to the second electrically conducting assembly by another one of the three fixing members, and the third connection seat is electrically connected to the third electrically conducting assembly by another one of the three fixing members.

10. The system of claim 1, wherein the support beam comprises a first support portion, a second support portion, and an electrically insulating connecting member connecting the first support portion and the second support portion, the first electrically conducting assembly is mounted on the first support portion, and the second electrically conducting assembly is mounted on the second support portion.

11. The system of claim 1, wherein the support mechanism further comprises an electrically insulating member, the first electrically conducting assembly comprises a first bearing pole, the second electrically conducting assembly comprises a second bearing pole, and the first bearing pole is connected to the second bearing pole by the electrically insulating member.

* * * * *